US011203943B2

(12) United States Patent
Wusatowska-Sarnek

(10) Patent No.: US 11,203,943 B2
(45) Date of Patent: Dec. 21, 2021

(54) WEAR RESISTANT TURBINE BLADE TIP

(71) Applicant: Raytheon Technologies Corporation, Farmington, CT (US)

(72) Inventor: Agnieszka M. Wusatowska-Sarnek, Manchester, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/862,830

(22) Filed: Apr. 30, 2020

(65) Prior Publication Data

US 2020/0291796 A1 Sep. 17, 2020

Related U.S. Application Data

(63) Continuation of application No. 15/920,878, filed on Mar. 14, 2018, now Pat. No. 10,662,788, which is a (Continued)

(51) Int. Cl.
*F01D 5/28* (2006.01)
*F01D 11/12* (2006.01)

(Continued)

(52) U.S. Cl.
CPC ..... *F01D 5/288* (2013.01); *C23C 8/68* (2013.01); *C23C 8/80* (2013.01); *F01D 11/122* (2013.01);

(Continued)

(58) Field of Classification Search
CPC . F01D 11/122; C23C 8/68; C23C 8/80; F05D 2300/506
See application file for complete search history.

(56) References Cited

U.S. PATENT DOCUMENTS 4,217,141 A * 8/1980 Schrittwieser ..... C22C 33/0292 75/244
4,689,242 A 8/1987 Pike (Continued)

FOREIGN PATENT DOCUMENTS

EP 3029113 A1 6/2016
EP 3081757 A2 10/2016
WO 8500837 A1 2/1985

OTHER PUBLICATIONS

European Search Report for European Application No. 19154707.4 dated Jun. 3, 2019, 8 pages.

(Continued)

*Primary Examiner* — Courtney D Heinle
*Assistant Examiner* — Danielle M. Christensen
(74) *Attorney, Agent, or Firm* — Cantor Colburn LLP

(57) ABSTRACT

A gas turbine engine includes: a turbine section including a casing extending circumferentially about a plurality of turbine blades and having at least one seal member coated with an abradable coating. At least one turbine blade has sides and a tip and at least one seal member is located adjacent to the tip of the at least one turbine blade. The tip of the at least one turbine blade has a wear resistant layer and an abrasive coating disposed on the wear resistant layer. The wear resistant layer has a thickness less than or equal to 10 mils (254 micrometers) and includes metal boride compounds.

17 Claims, 3 Drawing Sheets

Related U.S. Application Data continuation-in-part of application No. 15/887,494, filed on Feb. 2, 2018, now Pat. No. 10,662,799.

(51) Int. Cl.
*C23C 8/68* (2006.01)
*C23C 8/80* (2006.01)

(52) U.S. Cl.
CPC ..... *F05D 2220/3215* (2013.01); *F05D 2230/312* (2013.01); *F05D 2230/314* (2013.01); *F05D 2230/90* (2013.01); *F05D 2240/24* (2013.01); *F05D 2240/55* (2013.01); *F05D 2300/131* (2013.01); *F05D 2300/132* (2013.01); *F05D 2300/133* (2013.01); *F05D 2300/134* (2013.01); *F05D 2300/171* (2013.01); *F05D 2300/174* (2013.01); *F05D 2300/177* (2013.01); *F05D 2300/506* (2013.01); *F05D 2300/611* (2013.01)

(56) References Cited

U.S. PATENT DOCUMENTS

| | | | | |
|---|---|---|---|---|
| 4,741,973 | A | 5/1988 | Condit et al. | |
| 5,514,482 | A | 5/1996 | Strangman | |
| 6,060,174 | A | 5/2000 | Sabol et al. | |
| 7,510,370 | B2 | 3/2009 | Strangman et al. | |
| 8,021,120 | B2 * | 9/2011 | Schrey | F01D 11/12 416/224 |
| 9,341,066 | B2 * | 5/2016 | Bintz | F01D 5/20 |
| 9,431,066 | B1 | 5/2016 | Bintz et al. | |
| 2006/0057017 | A1 | 3/2006 | Woodfield et al. | |
| 2010/0284797 | A1 | 11/2010 | Jarrabet et al. | |
| 2013/0108463 | A1 | 5/2013 | Hathiwala et al. | |
| 2015/0267544 | A1 | 9/2015 | Gurt Santanach et al. | |
| 2015/0308276 | A1 | 10/2015 | Kleinow et al. | |
| 2016/0146024 | A1 * | 5/2016 | Morris | B23K 31/02 416/96 R |
| 2017/0101348 | A1 | 4/2017 | Wan et al. | |
| 2019/0003056 | A1 | 1/2019 | Raga et al. | |
| 2019/0242261 | A1 | 8/2019 | Wusatowska-Sarnek | |
| 2019/0242267 | A1 | 8/2019 | Wusatowska-Sarnek | |
| 2020/0291795 | A1 | 9/2020 | Wusatowska-Sarnek | |

OTHER PUBLICATIONS

European Search Report for European Application No. 19154827.0 dated Jun. 14, 2019, 10 pages.

European Office Action for European Application No. 19154707.4; Application Filing Date: Jan. 31, 2019; dated May 27, 2020; 4 pages.

Akshaya et al., "Microstructure evolution in boronized inconel 718 superalloy", Journal of Metallurgy and Materials Science, vol. 59, No. 1, Jan.-Mar. 2017, pp. 11-21.

Fangfang Xia , Michael D. Sangid , Yao Xiao , Xiaoguo Gong , Tieqiang Gang , Lijie Chen & Wei-Wei Xu (2020) Theoretical investigation of the crystallographic structure, anisotropic elastic response, and electronic properties of the major borides in Ni-based superalloys, Philosophical Magazine, 100:8, 998-1014, DOI: 10.1080/14786435.2020.1714089.

Khalili, Aria, "Effective Boronizing Process for Age Hardened Inconel 718" (2017). Electronic Thesis and Dissertation Repository. 4507. https://ir.lib.uwo.ca/etd/4507.

Mullendore, Author W., and Poe, Larry E., "Wear Resistance of Metastable Ni—B Alloys Produced by Chemical Vapor Deposition", Thin Solid Films, 153 (1987), pp. 267-279.

Campbell, et al., "The effect of boron on the microstructure and physical properties of chemically vapour deposited nickel films", Journal of Materials Science 23 (1988), p. 4049-4058.

* cited by examiner

WEAR RESISTANT TURBINE BLADE TIP

CROSS REFERENCE TO RELATED APPLICATIONS

This application is a continuation of U.S. patent application Ser. No. 15/920,878 filed on Mar. 14, 2018 which is a continuation in part of U.S. patent application Ser. No. 15/887,494 filed on Feb. 2, 2018 both of which are incorporated by reference in their entirety herein.

BACKGROUND

Exemplary embodiments pertain to the art of wear resistant turbine blade tips. Turbines in a turbine engine have one or more rows of rotating blades surrounded by the casing. To maximize engine efficiency, leakage of gas between the blade tips and casing should be minimized. This may be achieved by configuring the blade tips and casing seal such that they contact each other during periods of operation. With such a configuration, the blade tips act as an abrading component and the seal can be provided as an abradable seal. While the currently available combinations of abrasive tips and abradable seals are adequate it is envisioned that further improvements will be needed for the next generation of engine designs.

BRIEF DESCRIPTION

Disclosed is a gas turbine engine including: a turbine section including a casing extending circumferentially about a plurality of turbine blades and having at least one seal member coated with an abradable coating; wherein at least one turbine blade has sides and a tip and at least one seal member is located adjacent to the tip of the at least one turbine blade, wherein the sides have a thermal barrier coating (TBC) and the tip of the at least one turbine blade has a wear resistant layer and an abrasive coating disposed on the wear resistant layer, wherein wear resistant layer has a thickness less than or equal to 10 mils (254 micrometers) and includes metal boride compounds.

In addition to one or more of the features described above, or as an alternative to any of the foregoing embodiments, the wear resistant layer is formed in a base metal surface of the blade and the metal boride compounds include $M_3B_4$ and M can be titanium, vanadium, chromium, zirconium, niobium, molybdenum, tantalum, tungsten, or a combination thereof.

In addition to one or more of the features described above, or as an alternative to any of the foregoing embodiments, the wear resistant layer has a hardness of 1500 to 2500 HV 0.05 g.

In addition to one or more of the features described above, or as an alternative to any of the foregoing embodiments, the blade includes titanium, titanium alloy, steel, nickel, cobalt, nickel alloy, cobalt alloy, iron- or nickel- or cobalt-based superalloys or a combination thereof. The blade microstructure includes equiaxed grains, directionally solidified grains, or a single crystal structure that eliminates grain boundaries altogether. The blade can include cooling structures.

Also disclosed is a method of forming a seal between at least one seal member having an abradable coating, and at least one blade having sides and a tip, the method including: forming a wear resistant layer on the tip of the at least one blade; disposing an abrasive coating on the wear resistant layer; and coating the at least one seal member with an abradable coating, wherein the wear resistant layer includes metal boride compounds and has a thickness less than or equal to 254 micrometers.

In addition to one or more of the features described above, or as an alternative to any of the foregoing embodiments, the wear resistant layer is formed in a base metal surface of the blade and the metal boride compounds include $M_3B_4$ and M can be titanium, vanadium, chromium, zirconium, niobium, molybdenum, tantalum, tungsten, or a combination thereof.

In addition to one or more of the features described above, or as an alternative to any of the foregoing embodiments, the wear resistant layer has a hardness of 1500 to 2500 HV 0.05 g.

In addition to one or more of the features described above, or as an alternative to any of the foregoing embodiments, the blade includes titanium, titanium alloy, steel, nickel, cobalt, nickel alloy, cobalt alloy, iron- or nickel- or cobalt-based superalloys or a combination thereof. The blade microstructure includes equiaxed grains, directionally solidified grains, or a single crystal structure that eliminates grain boundaries altogether. The blade component includes uncooled or cooled structures.

In addition to one or more of the features described above, or as an alternative to any of the foregoing embodiments, the wear resistant layer is formed in a base metal surface of the blade by gaseous boronizing, liquid boronizing, powder boronizing, paste boronizing, chemical vapor deposition, plasma-assisted chemical vapor deposition, plasma vapor deposition, electron-beam plasma vapor deposition, glow discharge or a combination thereof.

In addition to one or more of the features described above, or as an alternative to any of the foregoing embodiments, wherein the wear resistant layer is formed by surrounding the blade with a source of metal atoms followed by surrounding the blade with a source of boron atoms.

In addition to one or more of the features described above, or as an alternative to any of the foregoing embodiments, a thermal barrier coating is deposited on the sides of the blade after the wear resistant layer is formed and prior to depositing the abrasive coating.

Also disclosed is an abrasive coating system on the tip of at least one metal turbine blade wherein the coating system includes an abrasive coating disposed on a wear resistant layer and the wear resistant layer includes metal boride compounds and has a thickness less than or equal to 254 micrometers.

In addition to one or more of the features described above, or as an alternative to any of the foregoing embodiments, the wear resistant layer is formed in a base metal surface of the blade and metal boride compounds include $M_3B_4$ and M can be titanium, vanadium, chromium, zirconium, niobium, molybdenum, tantalum, tungsten, or a combination thereof.

In addition to one or more of the features described above, or as an alternative to any of the foregoing embodiments, the wear resistant layer has a hardness of 1500 to 2500 HV 0.05 g.

In addition to one or more of the features described above, or as an alternative to any of the foregoing embodiments, the blade includes titanium, titanium alloy, steel, nickel, cobalt, nickel alloy, cobalt alloy, iron- or nickel- or cobalt-based superalloys or a combination thereof. The blade microstructure includes equiaxed grains, directionally solidified grains, or a single crystal structure that eliminates grain boundaries altogether. The blade can include cooling structures.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
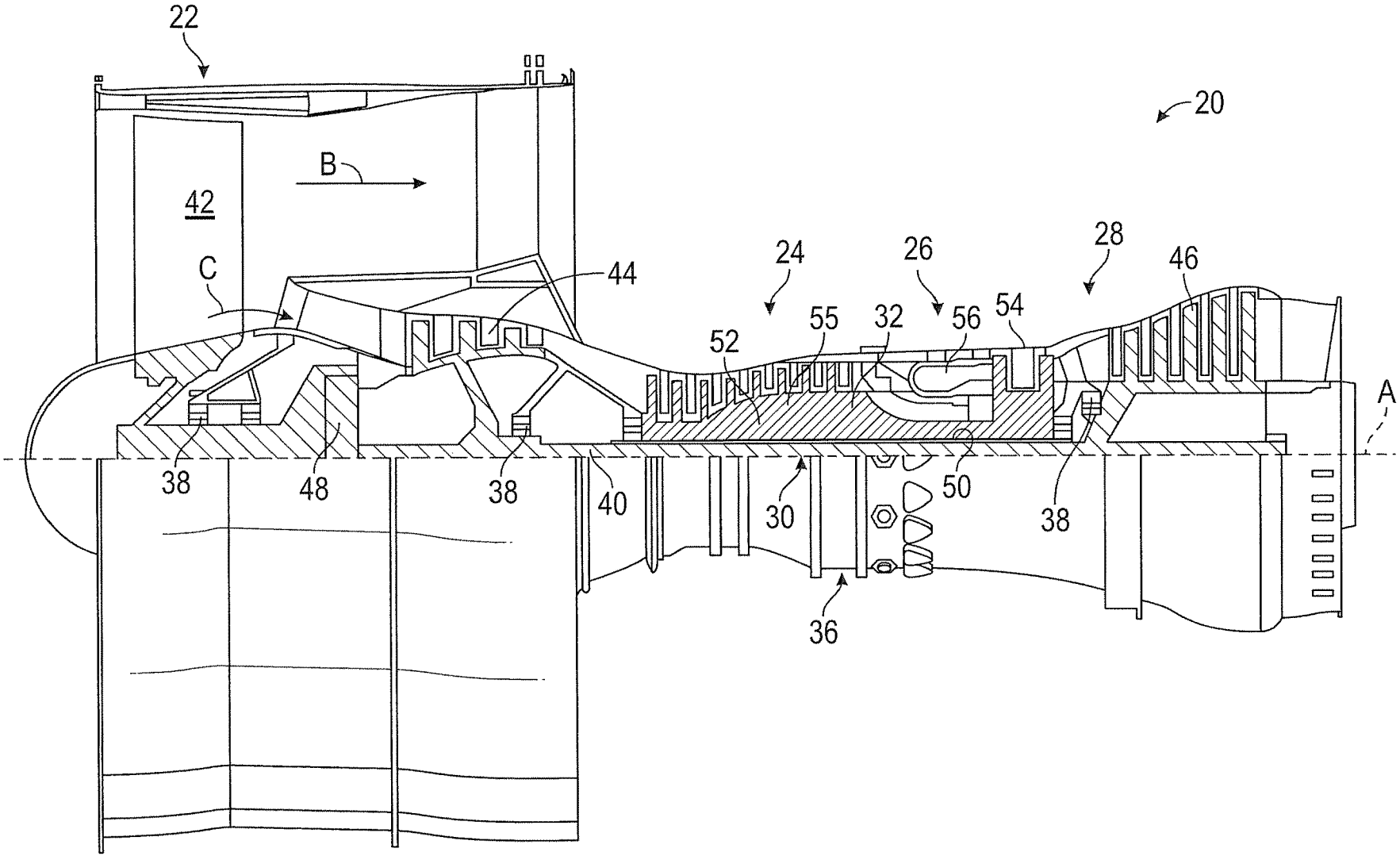
FIG. 1 is a cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. The high pressure compressor 52 includes rotor assembly 55. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

Figure 2:
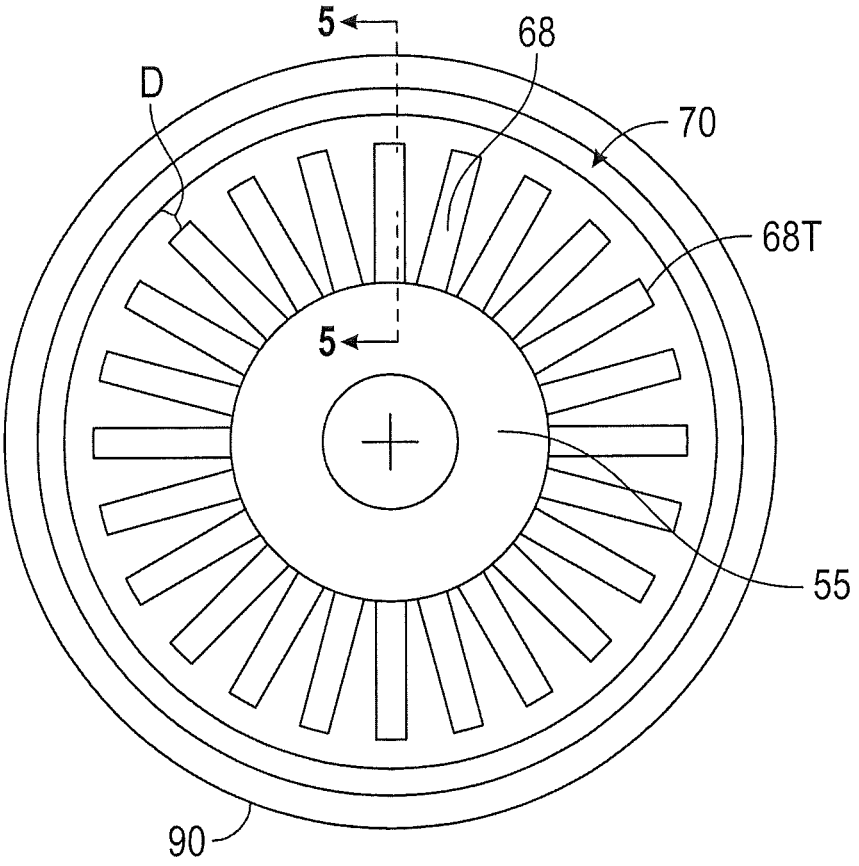
FIG. 2 is a cross-sectional view along line 4-4 of FIG. 1 illustrating the relationship of turbine casing and blades.
Figure 3:
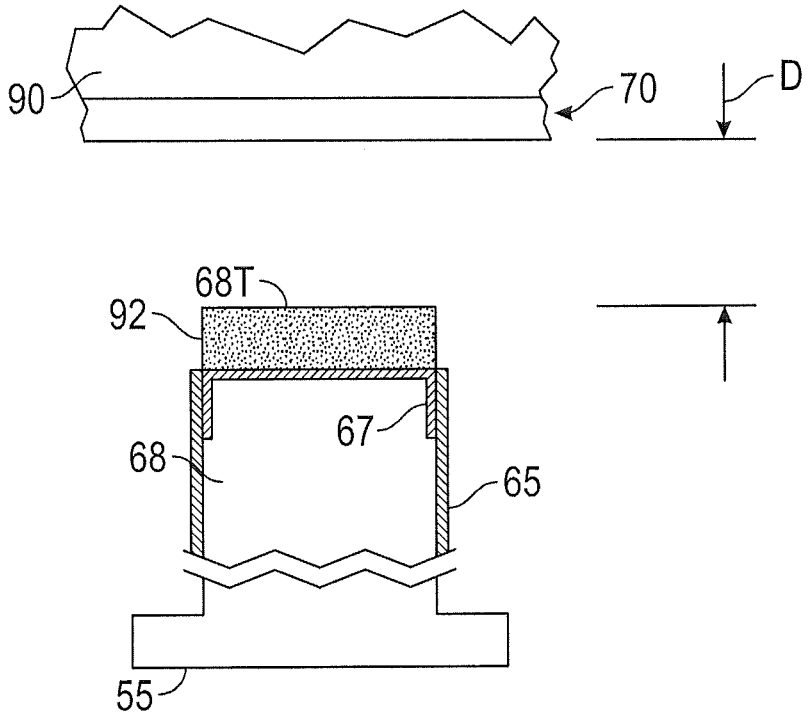
FIG. 3 is a cross-sectional view taken along the line 5-5 of FIG. 2.

FIG. 2 and FIG. 3 show the interaction of a turbine blade with a casing or shroud. FIG. 2 is a simplified schematic cross section of a portion of high pressure turbine 54 along line 4-4 of FIG. 1. FIG. 2 shows casing (or shroud) 90 which has a blade assembly 55 inside. Abradable coating 70, is on the casing 90 such that the clearance D between coating 70 and blade tips 68T of blades 68 with wear resistant layer 67 and abrasive coating 92 (shown in FIG. 3) has the proper tolerance for operation of the engine, e.g., to serve as a seal to prevent leakage of air (thus increasing efficiency), while not interfering with relative movement of the blades on the rotor assembly against the shroud. In FIGS. 2 and 3, clearance D is expanded for purposes of illustration. In practice, clearance D may be, for example, in a range of about 10 to 55 mils (245 to 1397 microns) when the engine is cold and 0 to 35 mils (0 to 889 microns) during engine operation depending on the specific operating condition and previous rub events that may have occurred.

FIG. 3 shows the cross section along line 5-5 of FIG. 2, with engine casing 90 and blade 68. Coating 70 is attached to casing 90, with a clearance D between coating 70 and blade tip 68T of blade with wear resistant layer 67 and abrasive coating 92. Clearance D varies with operating conditions, as described herein. Coating 70 is an abradable coating. Coating 65 is a thermal barrier coating. Abrasive coating 92 includes a MCrAlY matrix with abrasive particles such a cubic boron nitride, silicon carbide, or both embedded in the matrix. Due to the extreme operating conditions in the turbine, the abrasive coating may only survive through an initial break-in period, leaving the wear resistant layer 67 exposed.

Figure 4:
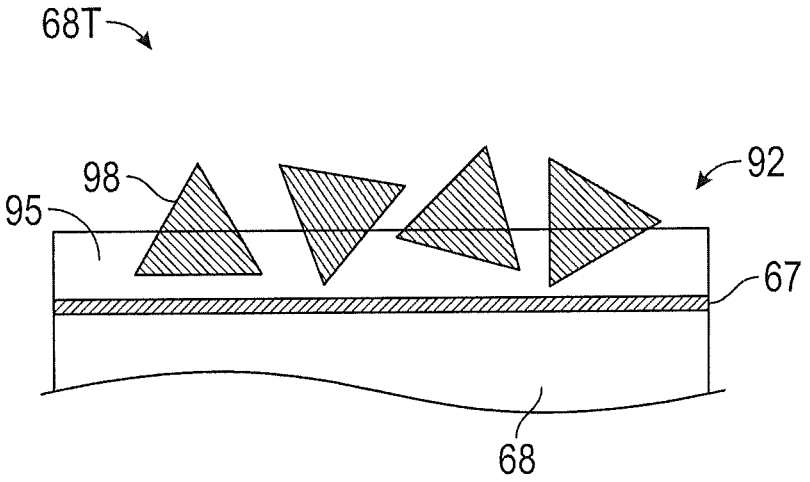
FIG. 4 is a representation of the abrasive coating deposited on the blade tip over the wear resistant layer.

FIG. 4 is an expanded view of blade tip 68T and shows abrasive coating 92 disposed on wear resistant layer 67. Abrasive coating 92 includes a MCrAlY matrix 95 with abrasive particles 98 disposed therein and adhered thereto.

Layer 67, described in detail below, is a wear resistant layer that is very smooth and has hardness at least an order to two orders of magnitude higher than the blade parent metal as well as the abradable coating. In operation, when the abrasive coating 92 is removed, the wear resistant layer will protect the blade tip from oxidation and, due to its superior cutting ability to abrade the coating 70, will reduce metal transfer from the blade tip to the abradable coating during sliding contact wear.

The blade may be made from a range of materials such as titanium, titanium alloy, steel, nickel, cobalt, nickel alloy, cobalt alloy, iron- or nickel- or cobalt-based superalloys or a combination thereof. The blade microstructure includes equiaxed grains, directionally solidified grains, or a single crystal structure that eliminates grain boundaries altogether. The blade component includes uncooled or cooled structures. Because the wear resistant layer is made by boronizing the blade itself (as described below), the rotor can be bladed or the rotor and the blades may be formed together.

The wear resistant layer is formed in the base metal surface of the blade and includes metal boride compounds. It is expressly contemplated that the wear resistant compound may include more than one metal boride compounds. Exemplary metal boride compounds include $M_3B_4$ (M=Ti, V, Cr, Zr, Nb, Mo, Ta, W, or a combination thereof) as well as simpler borides and diborides such as MB and $MB_2$. The specific composition of the coating will vary depending on the specific application and its requirements for sustaining rub interaction between the blade tip and the abradable seal as well as the abradable seal material properties. The wear resistant layer improves oxidation resistance and the cutting ability of the blade through the abradable coating and eliminates the metal transfer from the tip to the rubbed coating when the abrasive tip is removed. The wear resistant layer has a micro-hardness of 1500 to 2500 HV 0.05 g.

The wear resistant layer is formed by boronizing the blade. Boronizing is a diffusion process that saturates the substrate's surface with boron at an elevated temperature. In some embodiments boronizing includes surrounding the blade with a source of metal atoms (M) and a source of boron atoms (B). The metal atoms diffuse into the blade surface to locally enrich the chemical composition with an excess of M and combine with the boron to form the metal boride compounds such as $M_3B_4$ within the blade. In some embodiments, the source of metal atoms surrounds the blade first and then the source of boron atoms is provided. The use of an additional source of metal atoms promotes formation of metal borides comprising a metal that is either not a component of the blade alloy or is not present in excess in the composition of the blade alloy. Exemplary methods include gaseous boronizing which uses gaseous bonding agents (diborane, boron halides, and organic boron compounds), liquid boronizing which uses liquid bonding agents such as borax melts, optionally with viscosity-reducing additives. Gaseous and liquid boronizing can be performed with or without the use of electric current. Other boronizing methods include powder or paste-pack bonding using slurry suspensions. An additional metal source may be provided as a nanoparticulate suspension. The synthesis of the boron-based coating can be also conducted by chemical vapor deposition (CVD), plasma-assisted CVD, reactive electron-beam evaporation such as plasma vapor deposition (PVD) or electron beam PVD, glow discharge or a combination thereof. Vapor deposition methods may use multiple targets to provide an additional metal source. Exemplary temperatures employed for boronizing are 500 degrees C. to 1150 degrees C.

With respect to the wear resistant layer, metal boride compounds are formed in the base metal's surface and subsurface with a layer depth of 254 microns or less. The metal boride compounds form phases that are very hard phases that will resist wear and improve cutting ability of the blade tip. Borides also have low friction and low surface energy, so they will also resist transfer of the coating material to the blade tips. The oxidation resistance of the layer will also be improved.

The thickness of the wear resistant layer may be greater than or equal to 5 microns.

After the wear resistant layer is formed on the surface of the blade tip a thermal barrier coating 65 is applied to the blade sides. Thermal barrier coatings are known in the art and may be applied by any of the known methods.

After the thermal barrier coating is formed on the sides the abrasive coating is applied to the wear resistant layer on the tip. The abrasive coating can be applied by electrolytic deposition. The abrasive coating includes abrasive particles embedded in a matrix. The abrasive particles may include cubic boron nitride, silicon carbide, alumina, zirconia, or a combination thereof. The matrix may include MCrAlY, where M represents nickel, cobalt, aluminum, titanium, copper, chrome, or a combination thereof. The abrasive is homogeneously dispersed and covers 15 to 60 percent of the blade tip surface area. The abrasive coating may have a thickness of 20 to 300 micrometers measured from the interface between abrasive coating and the wear resistant layer to the surface of the abrasive layer.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A gas turbine engine comprising: a turbine section comprising a casing extending circumferentially about a plurality of turbine blades and having at least one seal member coated with an abradable coating; wherein at least one turbine blade is formed from a parent metal comprising nickel or a nickel alloy, and has sides and a tip and the at least one seal member is located adjacent to the tip of the at least one turbine blade, wherein the turbine blade sides have a thermal barrier coating and the tip of the at least one turbine blade has a wear resistant layer and an abrasive coating disposed on the wear resistant layer, wherein wear resistant layer has a hardness at least an order to two orders of magnitude higher than the blade parent metal and comprises metal boride compounds;

wherein the wear resistant layer has a hardness of 1500 to 2500 HV 0.05 g.

2. The gas turbine of claim 1, wherein the wear resistant layer is formed in a parent metal surface of the blade and the metal boride compounds comprise $M_3B_4$ and M can be titanium, vanadium, chromium, zirconium, niobium, molybdenum, tantalum, tungsten, or a combination thereof.

3. The gas turbine engine of claim 1, wherein the parent metal comprises titanium, titanium alloy, steel, nickel, cobalt, nickel alloy, cobalt alloy, iron- or nickel- or cobalt-based superalloys or a combination thereof.

4. The gas turbine engine of claim 1, wherein the parent metal comprises a microstructure and the microstructure comprises equiaxed grains, directionally solidified grains, or a single crystal structure.

5. The gas turbine engine of claim 1, wherein the blade comprises internal cooling structures.

6. A method of forming a seal between at least one seal member having an abradable coating, and at least one metal blade having sides and a tip, the method comprising: forming a wear resistant layer on the tip of the at least one metal blade; disposing an abrasive coating on the wear resistant layer; and coating the at least one seal member with an abradable coating, wherein the wear resistant layer comprises metal boride compounds and has a hardness at least an order to two orders of magnitude higher than the blade metal;

wherein the wear resistant layer has a hardness of 1500 to 2500 HV 0.05 g.

7. The method of claim 6, wherein the wear resistant layer is formed in a metal surface of the blade and the metal boride compounds comprise $M_3B_4$ and M can be titanium, vanadium, chromium, zirconium, niobium, molybdenum, tantalum, tungsten, or a combination thereof.

8. The method of claim 6, wherein the blade comprises titanium, titanium alloy, steel, nickel, cobalt, nickel alloy, cobalt alloy, iron- or nickel- or cobalt-based superalloys or a combination thereof.

9. The method of claim 6, wherein the blade comprises a microstructure and the microstructure comprises equiaxed grains, directionally solidified grains, or a single crystal structure.

10. The method of claim 6, wherein the blade comprises internal cooling structures.

11. The method of claim 6, wherein the wear resistant layer is formed in a metal surface of the blade by gaseous boronizing, liquid boronizing, powder boronizing, paste boronizing, chemical vapor deposition, plasma-assisted chemical vapor deposition, plasma vapor deposition, electron-beam plasma vapor deposition, glow discharge or a combination thereof.

12. The method of claim 6, wherein the wear resistant layer is formed by surrounding the blade with a source of metal atoms followed by surrounding the blade with a source of boron atoms.

13. The method of claim 6 further comprising depositing a thermal barrier coating on the sides of the blade after the wear resistant layer is formed and prior to depositing the abrasive coating.

14. An abrasive coating system on the tip of at least one metal turbine blade wherein the coating system comprises an abrasive coating disposed on a wear resistant layer and the wear resistant layer comprises metal boride compounds and has a hardness at least an order to two orders of magnitude higher than the blade metal;

wherein the wear resistant layer has a hardness of 1500 to 2500 HV 0.05 g.

15. The coating system of claim 14, wherein the wear resistant layer is formed in a metal surface of the blade and metal boride compounds comprise $M_3B_4$ and M can be titanium, vanadium, chromium, zirconium, niobium, molybdenum, tantalum, tungsten, or a combination thereof.

16. The coating system of claim 14, wherein the blade comprises titanium, titanium alloy, steel, nickel, cobalt, nickel alloy, cobalt alloy, iron- or nickel- or cobalt-based superalloys or a combination thereof.

17. The coating system of claim 14, wherein the blade comprises a microstructure and the microstructure comprises equiaxed grains, directionally solidified grains, or a single crystal structure.

* * * * *